United States Patent [19]

Mawson

[11] 4,108,571

[45] Aug. 22, 1978

[54] BLADED ROTOR ASSEMBLY FOR A GAS TURBINE ENGINE

[75] Inventor: Robert James Mawson, Derby, England

[73] Assignee: Rolls-Royce Limited, London, England

[21] Appl. No.: 764,690

[22] Filed: Feb. 1, 1977

[30] Foreign Application Priority Data

Feb. 11, 1976 [GB] United Kingdom ..... 5335/76

[51] Int. Cl.[2] ..... F01D 5/32

[52] U.S. Cl. ..... 416/221; 416/95

[58] Field of Search ..... 416/220, 221, 95

[56] References Cited

U.S. PATENT DOCUMENTS

| | | | |
|---|---|---|---|
| 3,501,249 | 3/1970 | Scalzo et al. | 416/220 X |
| 3,572,966 | 3/1971 | Borden et al. | 416/220 X |
| 3,853,425 | 12/1974 | Scalzo et al. | 416/221 X |
| 3,887,298 | 6/1975 | Hess et al. | 416/220 |
| 3,936,227 | 2/1976 | Wojcik | 416/95 |
| 3,957,393 | 5/1976 | Bandurick | 416/95 X |
| 4,021,138 | 5/1977 | Scalzo et al. | 416/220 X |

*Primary Examiner*—Everette A. Powell, Jr.

*Attorney, Agent, or Firm*—Cushman, Darby & Cushman

[57] ABSTRACT

A bladed rotor assembly for a gas turbine comprises blades whose roots are held in slots in a blade carrying member. In order to retain the blades against movement in the slots locking members engage with the blades and the member. At least one of the engagements comprises a projection defining an undercut into which an edge of the locking member engages. In order to reduce frettage, the edge and the undercut are shaped to form a groove which tapers so that its section reduces in the radially outward direction, and a wedging member is mounted in the groove so that it tends to centrifuge outward in the groove and wedge the edge in the undercut against a wall of the undercut.

7 Claims, 4 Drawing Figures

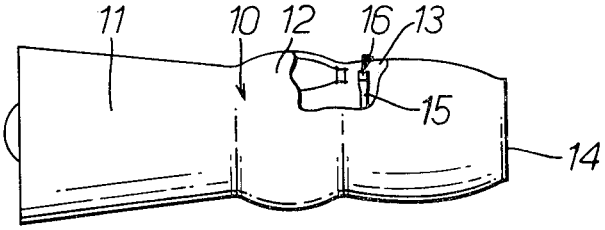
Fig.1
Fig.2
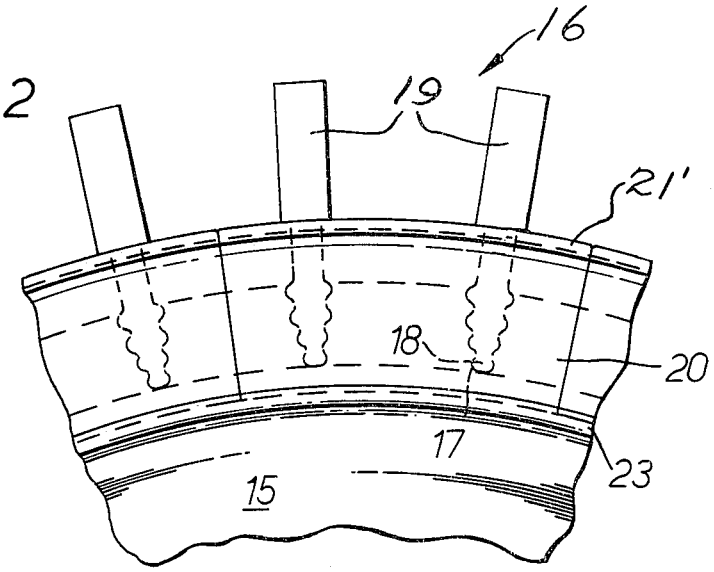
Fig. 3
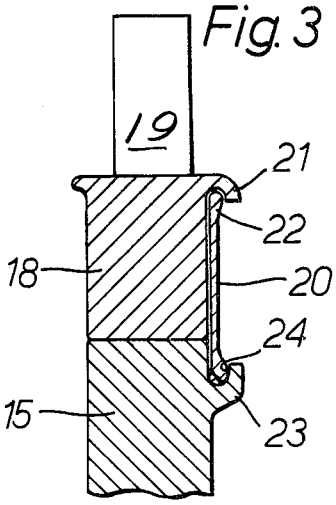
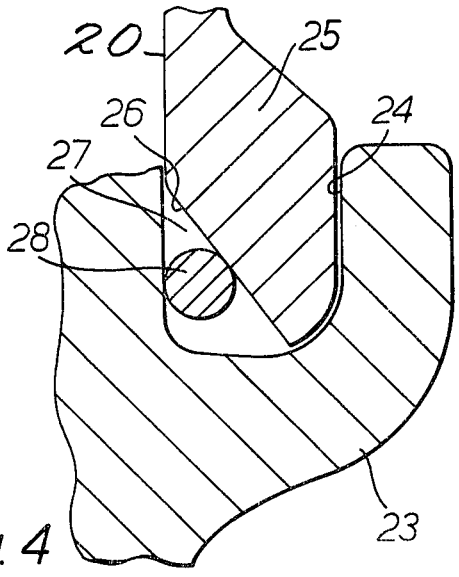
Fig. 4

BLADED ROTOR ASSEMBLY FOR A GAS TURBINE ENGINE

This invention relates to a bladed rotor assembly for a gas turbine engine.

BACKGROUND OF THE INVENTION

In such assemblies it is normal for a blade carrying member to be provided with a plurality of slots, normally axial or having some axial extent, within each of which there extends the root portion of one of the blades, the engagement between the root and the slot retaining the blade against radial movement. It is necessary to provide some means for preventing the blade root moving longitudinally in the slot, and one way of carrying this out is to provide lock members which engage both with the blade carrying member and with the blade. The engagement between the lock members and the blade carrying member and/or the blade conveniently comprises a projecting undercut portion of the member or blade which traps the edge of the plate, but it has been found that vibration of the plate can cause fretting between the plate edge and the projecting portion, which in extreme cases may cause the projecting portion to be worn completely away and to free the lock member.

The present invention provides a construction in which the lock member may in operation be clamped more rigidly in place.

BRIEF SUMMARY OF THE INVENTION

According to the present invention a bladed rotor assembly for a gas turbine engine comprises a blade carrying member having slots in its periphery adapted to engage root portions of the blades to retain them to the member, and lock members engaging with the blades and the blade carrying member so as to prevent longitudinal movement of the root portions in the slots in at least one direction, the engagement between the lock members and either or both of the blades and the blade carrying member comprising an undercut projection from the blade carrying member and/or blade in the undercut of which engages an edge of the lock member, said edge and undercut being shaped to form a groove therebetween which tapers so that its section reduces in a radially outward direction, and a wedging member mounted in said groove so that in operation centrifugal effects on the wedging member cause it to tend to move radially outward in the groove to wedge said edge in said undercut.

Preferably said wedging member is mounted in a groove formed in the undercut projection from the blade carrying member which is the radially inner of the two projections, centrifugal loads on the lock member producing clamping loads between the member and the outer projection.

The wedging member may comprise a malleable wire, while the locking members may each comprise a plate which is one of a plurality together forming a complete annulus; in this case a single wire may act as the wedging member for the annulus of lock plates.

BRIEF DESCRIPTION OF THE DRAWINGS

The invention will now be particularly described, merely by way of example, with reference to the accompanying drawings in which:

FIG. 1 is a partly broken away view of a gas turbine engine incorporating a bladed rotor assembly in accordance with the invention, FIGS. 2 and 3 are an axial view and a radial section respectively of the bladed rotor of FIG. 1 in accordance with the invention, and FIG. 4 is an enlargement of part of FIG. 3.

DETAILED DESCRIPTION OF THE INVENTION

In FIG. 1 there is shown a gas turbine engine comprising a casing 10, within which are mounted in flow series a compressor 11, combustion section 12, turbine 13 and which forms a final nozzle 14. Operation of the engine is conventional in that air is taken in and compressed by the compressor 11, fuel is added to the compressed air in the combustion section 12, the hot exhaust gases from this combustion section drive the turbine 13 and exhaust through the propulsion nozzle 14 to provide propulsive thrust. The compressor 11 and turbine 13 are drivingly interconnected so that the compressor is driven by the turbine.

Both the compressor 11 and the turbine 13 are of the axial flow type and each comprises a rotor which carries at least one annular array of rotor blades. The casing is broken away to show the turbine rotor 15 and its single row of rotor blades generally indicated at 16, and these parts are shown in greater detail in FIGS. 2 and 3.

From FIG. 2 it will be seen that the rotor 15 comprises a blade carrying member in the form of a disc in the periphery of which are formed a plurality of fir-tree slots 17. These slots are of the serrated form which is known generally in the art as a fir-tree shape, and normally extend either axially or at an acute angle to the axial direction, although it will be appreciated that slots in other directions could be used. Within each slot 17 there is retained a correspondingly fir-tree shaped root 18 of a rotor blade 19. Engagement between the serrations and projections of the root 18 and the slot 17 prevents the blade 19 from moving radially, but it will be understood that it is possible for the root 18 to slide longitudinally in the slot and 17 that therefore it is necessary to provide retention means.

In the present case the retention means which prevents the blades from moving to the right as shown in FIG. 3 comprises a plurality of part-annular lock plates 20 which engage both with the disc 15 and the root 18 of blade 19. As can be best seen in FIG. 3, the blade 19 is provided with an hooked projection 21 defining an undercut, the undercut of which faces towards the axis of the disc 15. It will be seen from FIG. 2 that the projections 21 together make up an annular undercut flange 21'. The lock plate 20 is provided with a thickened or turned over outer edge 22 which engages with the undercut of the projection 21.

Again the disc 15 is provided with an annular undercut flange or projection 23, in this case the undercut 24 defined by the flange 23 faces radially outwards.

The engagement of the plate 20 and the projection 23 is best seen in FIG. 4 and it will be seen that once again the lockplate 20 is provided with a thickened edge 25 which engages in the undercut 24. Although the edges 22 and 25 are sized so as to fit closely in the respective undercuts, it will be appreciated that particularly in the case of the radially inner edge 25, there may be sufficient freedom for the plate 20 to vibrate and to cause frettage of the flange or projection 23. Centrifugal effects on the lock plate 20 will reduce frettage of the projection 21 at the outer edge 20. Therefore the inner edge of the lock plate is provided with a chamfered face 26 which together with the adjacent face of the disc forms a tapered groove 27, the angle of the chamfer being such as to cause the groove to reduce in section in a radially outwards direction. Retained in the groove 27 there is a wire 28 which is formed of a malleable material; this wire may form a complete or split ring or it may comprise a plurality of separate pieces.

It will be seen that in operation centrifugal effects on the wire 28 will cause it to tend to move radially outwards into the taper of the groove 27 and that therefore the edge 25 will be clamped up against the wall or face of the undercut 24. This wedging action will therefore reduce the amount of frettage.

It will be seen that the lock plates 20 serve to prevent longitudinal movement of the roots 18 in their slots 17, although the efficacity of this locking action is clearly greater in one direction.

It will be appreciated that although described for the lock plates of turbine rotor blades the present invention could clearly be applied to compressors and could if necessary be used on the outer edge of the lock plates (in the present instance this would involve the edge 22). It will also be understood that it is possible to use the invention with other locking devices than plates, and that the wedging member need not comprise a malleable wire.

I claim:

1. A bladed rotor assembly for a gas turbine engine comprising: a plurality of blades each having a root portion, a blade carrying member having a plurality of slots in its periphery, each slot being arranged to receive and engage the root portion of one of said blades to radially retain the same to said blade carrying member, and lock members in engagement with said blades and said blade carrying member for preventing longitudinal movement of the root portion of each of the blades in the slots in at least one direction, at least one of the engagements comprising a projection defining an undercut and an edge of each of the lock members engaging in said undercut, said edge of each of said lock members having a chamfered edge which cooperates with a surface of said undercut to form a tapered groove therebetween having a section which reduces in a radially outward direction, and a wedging member separate from said lock members and from said undercut, said wedging member being mounted in said tapered groove and cooperating with both said chamfered edge of each of said lock members and said surface of said undercut so that in operation of the bladed rotor assembly centrifugal effects on said wedging member cause the wedging member to tend to move radially outward in the tapered groove to longitudinally wedge said edge of each of said lock members in said undercut against a wall of the same.

2. A bladed rotor assembly as claimed in claim 1 in which said chamfered edge on said edge of each of said lock members is an inner edge and in which said wedging member wedges said lock members longitudinally outwardly against an inwardly facing surface of said undercut.

3. A bladed rotor assembly as claimed in claim 1 and in which said wedging member comprises a malleable wire.

4. A bladed rotor assembly as claimed in claim 1 in which there are projections from each of said blades defining undercuts and from said blade carrying member defining an undercut, the undercuts on the projections from said blades facing the undercut on the projection from the blade carrying member, and said lock members engaging between said facing undercuts.

5. A bladed rotor assembly as claimed in claim 4 and in which said projections from said blades abut to form an annular projection, the undercuts also abutting to form an annular undercut.

6. A bladed rotor assembly as claimed in claim 5 and in which the projection from the blade carrying member comprises an annular projection having an annular undercut formed therein.

7. A bladed rotor assembly as claimed in claim 6 and in which said lock members comprise part-annular members which abut together to form a complete annulus which extends between said annular undercuts.

* * * * *